US006944887B2

(12) United States Patent
Heine et al.

(10) Patent No.: US 6,944,887 B2
(45) Date of Patent: Sep. 20, 2005

(54) ANTIGLARE SYSTEM FOR A CRASH HELMET

(76) Inventors: Gernot Heine, Im Hassel 15, Goettingen (DE), D-37077; Jörg Strobel, Opferbach 12, Goettingen (DE), D-37077

( * ) Notice: Subject to any disclaimer, the term of this patent is extended or adjusted under 35 U.S.C. 154(b) by 0 days.

(21) Appl. No.: 10/333,616

(22) PCT Filed: Jul. 18, 2001

(86) PCT No.: PCT/DE01/02687

§ 371 (c)(1),
(2), (4) Date: Jul. 7, 2003

(87) PCT Pub. No.: WO02/07551

PCT Pub. Date: Jan. 31, 2002

(65) Prior Publication Data

US 2004/0010833 A1 Jan. 22, 2004

(30) Foreign Application Priority Data

Jul. 22, 2000 (DE) ..... 100 35 740
Feb. 14, 2001 (DE) ..... 201 06 330 U

(51) Int. Cl.[7] ..... A42B 1/08; A61F 9/00
(52) U.S. Cl. ..... 2/424; 2/12; 2/432
(58) Field of Search ..... 2/424, 12, 15, 2/432, 434

(56) References Cited

U.S. PATENT DOCUMENTS 1,130,634 A * 3/1915 Rooney ..... 351/47
2,146,544 A * 2/1939 Kleine ..... 2/12
3,384,903 A * 5/1968 Malcom, Jr. ..... 2/434
3,868,727 A * 3/1975 Paschall ..... 2/8
4,057,852 A * 11/1977 Contant ..... 2/12
4,076,373 A * 2/1978 Moretti ..... 359/507
4,153,952 A * 5/1979 Dussich ..... 2/12
4,528,232 A * 7/1985 Cliffe ..... 428/195.1
5,502,516 A * 3/1996 Elterman ..... 351/47
5,555,570 A 9/1996 Bay, Jr.
5,991,072 A * 11/1999 Solyntjes et al. ..... 359/361
6,006,366 A 12/1999 Vondrak
6,085,358 A * 7/2000 Cogan ..... 2/424
6,134,719 A * 10/2000 Kuo ..... 2/424

FOREIGN PATENT DOCUMENTS

| | | | | |
|---|---|---|---|---|
| DE | 83 33 346.0 U1 | | 3/1984 | |
| DE | 35 17 411 A1 | | 11/1986 | |
| DE | 4040880 A1 | * | 6/1992 | ..... A42B/3/22 |
| DE | 4330708 A1 | * | 3/1995 | ..... F21V/9/14 |
| EP | 0 099 524 A | | 2/1984 | |
| EP | 0 590 255 A1 | | 4/1994 | |
| FR | 2 394 261 A | | 1/1979 | |

OTHER PUBLICATIONS

Patent Abstracts of Japan, vol. 1999, No. 05, May 31, 1999 & JP 11 050326 A (Kusumi Daizou), Feb. 23, 1999.

* cited by examiner

*Primary Examiner*—Rodney M. Lindsey
(74) *Attorney, Agent, or Firm*—Birch, Stewart, Kolasch & Birch, LLP

(57) ABSTRACT

Antiglare system for a crash helmet with an outer and an inner helmet shell that has an eyeport that can be closed by a visor and that can be partially covered by a sunshade, wherein the sunshade has at least one first antiglare module and covers the eyeport in a upper region such a way that the sunshade is located above a horizontal line of sight and outside of a vertical field of vision when the wearer's head is in a relaxed, fairly upright position, and wherein the sunshade extends into the vertical field of vision when the helmet wearer's head is tilted forward.

21 Claims, 4 Drawing Sheets

ANTIGLARE SYSTEM FOR A CRASH HELMET

This application is the national phase under 35 U.S.C. § 371 of PCT International Application No. PCT/DE01/02687 which has an International filing date of Jul. 18, 2001, which designated the United States of America.

BACKGROUND OF THE INVENTION

1. Field of the Invention

The invention relates to an antiglare system for a crash helmet with an outer and an inner helmet shell that has an eyeport, part of which can be covered by a sunshade.

2. Description of the Background Art

Crash helmets or protective helmets, particularly for motorcycle or snowmobile drivers, usually include a hard outer helmet shell and an inner, deformable shock-absorbing helmet shell. The designs known as full face helmets have an eyeport or visor opening that is bordered on the bottom by a chin protector and that can be covered by a visor made of transparent material that moves on pivot points on both sides of the eyeport in order to protect the eyes from dust, impacting insects, etc. Also known are helmets called jet helmets, whose eyeports are open at the bottom in the vertical direction. These helmets are available with and without visors.

The human eye is not capable of adapting quickly and effectively enough when the sun is low in the sky or when encountering oncoming lights in the dark. Consequently, painful dazzling of the eyes and premature fatigue on the part of the driver or helmet wearer can occur. While effective antiglare protection must be achieved very quickly in the case of dazzling, it is important during periods of darkness that as much light as possible reach the driver's eyes.

Known from G 83 33 346.0 U1 is a crash helmet with an outer and an inner helmet shell having an eyeport that can be closed by a visor and can be partially covered by a sunshade. An antiglare shield can slide into a pocket-like recess in the helmet shell above the edge of the visual field. Depending on light conditions, the antiglare shield can be moved down into the visual field before or during travel.

A disadvantage of the known antiglare protection is that an appropriate recess must be incorporated in the crash helmet, and as a result, the protection cannot be retrofitted universally. Moreover, a suitable receiving pocket and a requisite adjustment mechanism for the adjustment is complicated and relatively expensive. Individual adjustment during travel can also lead to inattention on the part of the driver with concomitant hazard.

Known from DE 35 17 411 A1 is a sunshade that is removably attached in the upper visual field of a protective helmet visor. Disadvantages of this known antiglare protection are, firstly, that only helmets with protective helmet visors intended for this purpose can be retrofitted with the sunshade part, and secondly, that 20% to 70% of the area of the visor plate is covered by this part. This means that the visor must be raised, as stated, for example for travel through tunnels, so that the visual conditions improve appropriately in a tunnel.

In addition, a crash helmet is known from EP 0 590 255 A1 that has an additional visor as a sunshade mounted on the outer helmet shell.

The additional visor can be moved, by means of an operating element guided in a longitudinal slot, from a first position that leaves the visual field free to a second position that partially covers the visual field.

A disadvantage of this known design as well is that the driver must take at least one hand from the handlebar in order to operate the operating element or swivel mechanism, and precisely at a point when the driver's full attention is needed. Moreover, it is difficult to operate a swivel mechanism with a gloved hand while driving. At the onset of darkness, such antiglare protection must be removed from the line of sight. A further disadvantage is that the driver cannot react quickly enough to changing light conditions. Furthermore, such a crash helmet requires a great deal of design effort and is relatively expensive as a result. In addition, protruding edges of the operating element can cause wind noise in the helmet.

SUMMARY OF THE INVENTION

The object of the present invention is to create a safety-enhancing antiglare helmet that permits rapid adjustment of the antiglare effects to different light conditions where the driver can achieve optimal antiglare protection without having to remove a hand from the handlebar. In addition, it is desirable for such antiglare protection or antiglare protection system to be economical to manufacture without great design effort.

This object is achieved in accordance with the invention in that the sunshade can be retrofitted to ordinary commercial crash helmets and in that the sunshade has at least one antiglare module that is arranged between the outer and inner helmet shells with an upper region located outside of the eyeport in such a way that the sunshade is located above a horizontal line of sight and outside of a vertical field of vision when the wearer's head is in a relaxed, fairly upright position, and in that the helmet wearer can swivel the sunshade into his vertical field of vision by tipping his head forward.

As a result of its arrangement in accordance with the invention, the antiglare system can be installed permanently without being adversely noticeable in darkness. It is no longer necessary for the driver to remove a hand from the handlebar while driving or, worse, interrupt the trip in order to make full use of the antiglare protection. The antiglare system need not be removed or manually operated in any way in order to ensure optimal visibility at dusk or in darkness. When the antiglare system is used, there is no perceptible increase in helmet weight for the helmet wearer or driver, nor is any additional wind noise generated. The antiglare system can be combined at least partially with all known antiglare devices to increase the antiglare effect when driving toward intense light. An additional advantage of the invention is that the eyes are already so significantly relieved by the shadow cast by the antiglare system in bright light and midday sun that it is no longer necessary in these cases to wear sunglasses, for example. The antiglare system in accordance with the invention does not require great design effort and is relatively economical to install. The helmet wearer brings the sunshade into his vertical field of vision merely by tilting his head forward. Tilting the head is done reflexively in this context.

As a result of the fact that the antiglare system or the sunshade can be retrofitted to a variety of ordinary, commercial crash helmets, the crash helmets can be designed economically. The antiglare system can be retrofitted to both full face helmets and jet helmets. This retrofitting can be accomplished quickly and simply without tools and without structural changes to the ordinary commercial crash helmets. As a result of the arrangement of the one antiglare module between the outer and inner helmet shells, no special pocket-like recess is required.

In accordance with a preferred embodiment of the invention, a second antiglare module is arranged parallel to the first antiglare module and extends beyond the first antiglare module toward the horizontal line of sight.

As a result of the arrangement of two parallel antiglare modules, the helmet wearer can adjust the antiglare effect to his needs. As a result of the arrangement of a second antiglare module, firstly, the degree of tint or antiglare effect can be increased, and secondly, a graduated antiglare effect can be achieved with antiglare modules of differing widths, which is to say one extending beyond the other. The helmet wearer can thus adjust the antiglare effect in two levels by means of different head tilts.

In accordance with another preferred embodiment of the invention, the sunshade can have a third antiglare module parallel to the second antiglare module. Insofar as the third antiglare module likewise extends beyond the second antiglare module, the antiglare effect can be regulated in three levels by appropriate head tilting on the part of the helmet wearer. Due to the modular construction of the antiglare system, a unique capacity is provided for adapting the antiglare system to the individual needs of the driver.

In accordance with another preferred embodiment of the invention, the first antiglare module is arranged on an outer side of the visor facing away from the helmet wearer, and the second antiglare module is arranged on the inner side of the visor facing the wearer.

As a result of the arrangement on the visor, the antiglare modules can be attached relatively simply and securely to the crash helmet.

Nearly all commercial crash helmets without sunshades can be retrofitted simply and economically with the appropriate embodiment of the antiglare system. Individualized adjustment to the helmet wearer's needs can be accomplished at the same time.

In accordance with a preferred embodiment of the invention, the third antiglare module, which of course can also be used as the sole antiglare module, has, in the upper region located outside of the visor opening, on its inner side facing away from the visor, two fasteners made of a brushed velour material. The fasteners have, on their outer side facing away from the antiglare module, a napped layer oriented away from an upper side of the antiglare module. By this means, the upper region of the third antiglare module can be inserted between the outer and inner helmet shells simply and without the application of force. The inner helmet shell then presses perpendicularly against the antiglare module and against its napped layer of brushed velour. Withdrawal of the third antiglare module must take place against the direction of the nap or pile of the napped layer and requires significantly more force than insertion. The brushed velour fasteners thus serve to ensure reliable position retention.

In principle, it is also possible to arrange multiple antiglare modules on top of one another. It is also possible to design an antiglare module with progressive or graduated antiglare effect.

In accordance with another preferred embodiment of the invention, at least one antiglare module has a coating with reflective properties.

As a result of the reflective coating, passive safety for the helmet wearer is improved in that he is better visible to others on the road. As a result of the capability to combine the three antiglare modules in an individualized fashion with regard to their position, color, and graphic design, the driver additionally achieves the result that his crash helmet is nearly unmistakable.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further details of the invention will become apparent from the following detailed description and the attached drawings, which illustrate preferred embodiments of the invention by way of example, wherein.

DETAILED DESCRIPTION OF THE PREFERRED EMBODIMENTS

Figure 1:
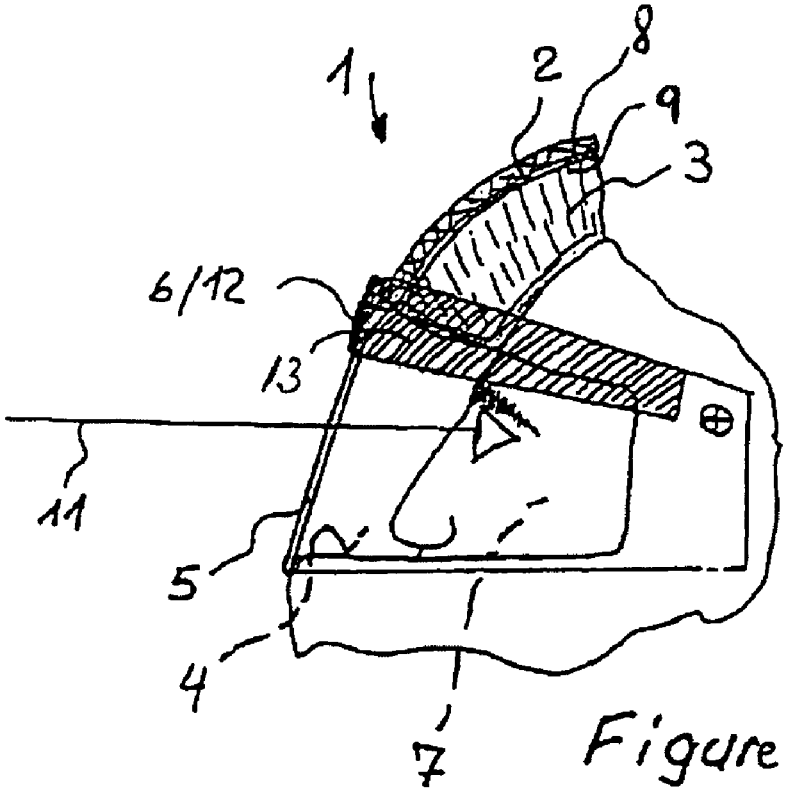
FIG. 1 is a partial side view of an antiglare system in cross-section and outline with an antiglare module arranged on the outside of the visor.

An antiglare system according to an embodiment of the present invention includes a crash helmet 1 with an outer helmet shell 2, an inner helmet shell 3, an eyeport 4, a visor 5, and a sunshade 6.

The hard outer helmet shell 2 is arranged on an outer side 8 of the crash helmet 1 facing away from a helmet wearer 7. The inner helmet shell 3 is arranged on an inner side 9 of the crash helmet 1 facing toward the helmet wearer 7. The inner helmet shell 3 is designed as a deformable and shock-absorbing shell. The eyeport 4 provides the eye of the helmet wearer with a vertical field of vision 10 of greater than 55° in the vertical direction. The eyeport 4 is closed by the visor 5 that can be pushed up and out of the way. The visor 5 is made of a crystal-clear transparent material.

The sunshade 6 partially covers the eyeport 4 in its upper region in the vertical direction, and specifically, in such a manner that the sunshade 6 is located above a horizontal line of sight 11 and outside of the vertical field of vision 10 when the head of the helmet wearer 7 is in a relaxed, fairly upright position. When the head of the helmet wearer 7 is tilted forward, the sunshade 6 extends into the vertical field of vision 10 and the horizontal line of sight 11.

In an embodiment as shown in FIG. 1, the sunshade 6 includes a first antiglare module 12 that is arranged on an outer side 13 facing away from the helmet wearer 7 in the vertical direction at the upper edge of the visor 5.

Figure 2:
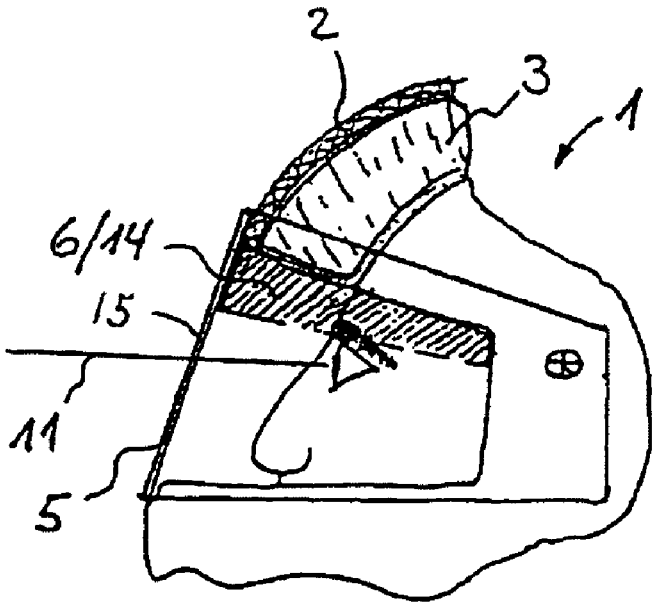
FIG. 2 is a partial side view of an antiglare system in cross-section and outline with an antiglare module arranged on the inside of the visor.

In an embodiment as shown in FIG. 2, the sunshade 6 includes a second antiglare module 14 that is arranged on an inner side 15 of the visor 5 facing the helmet wearer 7. The antiglare modules 12, 14 can be embodied as self-stick film, for example. However, it is also possible to affix the antiglare modules 12, 14 to the visor 5 such that they are secure against dislocation using hook-and-loop fasteners or other fasteners, such as Velcro, that are not shown.

Figure 3:
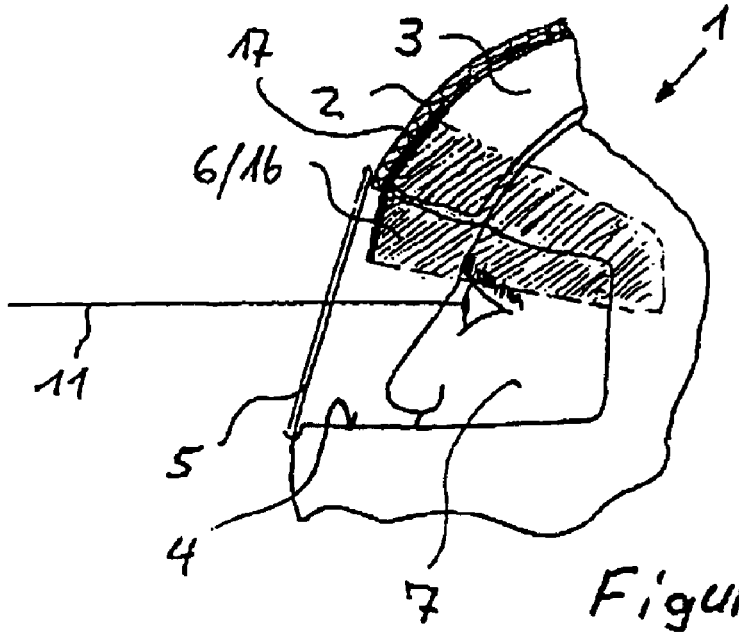
FIG. 3 is a partial side view of an antiglare system in cross-section and outline with an antiglare module arranged between the outer and inner helmet shells.

In an embodiment as shown in FIG. 3, the sunshade 6 is designed as a third antiglare module 16 whose upper region 17 located outside of the eyeport 4 can be placed between the outer helmet shell 2 and the inner helmet shell 3. Secure retention of the third antiglare module 16 inserted between the outer helmet shell 2 and inner helmet shell 5 is already achieved in that rubbing-induced friction exists between the helmet shells 2, 3 and the third antiglare module 16. Additional improvement of the retention can be achieved, for example, through any form of barbs, adhesives, or the use of hook-and-loop fasteners, etc. The third antiglare module 16 includes a flexible, dimensionally stable material so that it can adjust to the curvature of the helmet shells and the friction is increased by the material's tendency to return to its original shape.

Figure 8:
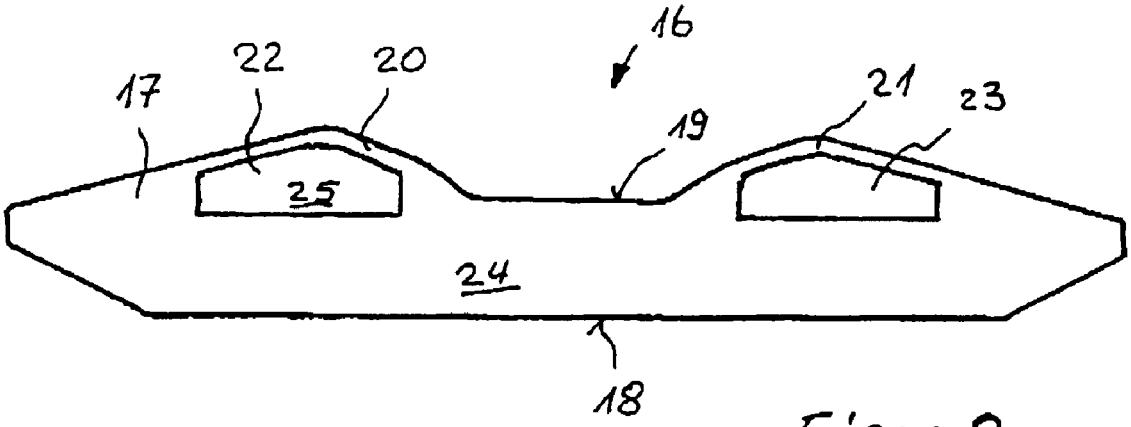
FIG. 8 is a rear view of a third antiglare module with two fasteners.
Figure 9:
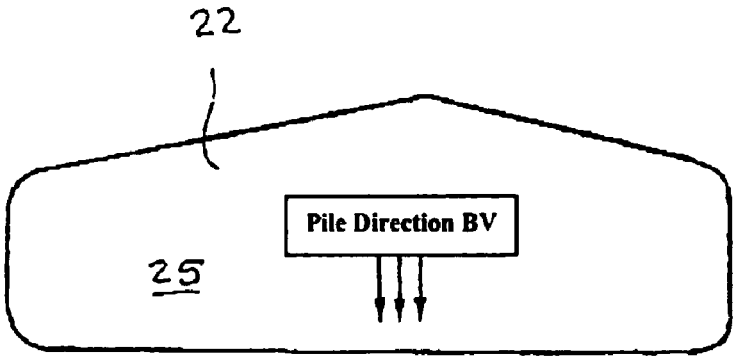
FIG. 9 is an enlarged rear view of the fastener from FIG. 8.

The third antiglare module 16 can have an outline as shown in FIG. 8. The bottom side 18 facing away from the upper region 17 is designed essentially as a straight line, and runs essentially horizontally in the installed state. In the installed state, the top side 19 facing away from the bottom side 18 has, in the upper region 17 located outside of the visor opening 4, two convex forms 20, 21 arranged a distance from one another that are usefully arranged in bilateral symmetry with respect to one another. Due to the convex forms 20, 21, the antiglare module 16 can be inserted easily between the outer helmet shell 2 and inner helmet shell 3. One fastener 22, 23 each is arranged on the inner side 24 facing away from the visor 5 in the upper region 17 and in the area of the convex forms 20, 21. The fasteners 22, 23 are made of a brushed velour material, such as is sold by the Girmes company under the name "GIRMES IN-B ürstenvelours", for example. The brushed velour material or the fasteners 22, 23 have on their outer side 25 facing away from the antiglare module 16 a napped layer or pile direction of the brushed velour (BV) oriented away from the upper side 19. It is useful for the fasteners 22, 23 to have, on their ends facing the upper side 19 of the antiglare module 16, an outline shape that matches the upper side 19. It has proven useful to position the fasteners 22, 23 at a distance from the upper side 19, as shown in FIG. 9. The fasteners are adhered to the inner side 24, for example by means of a self-adhesive film.

Figure 4:
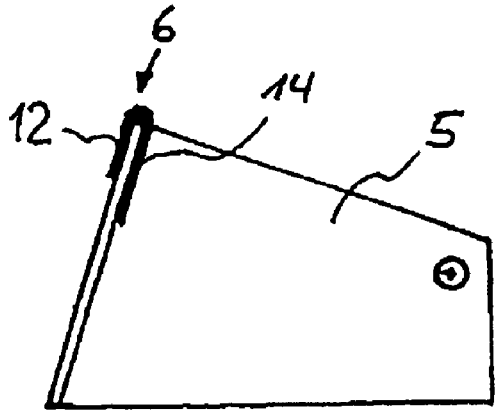
FIG. 4 is a side view of a visor in cross-section and outline with an antiglare module arranged on the outside and one arranged on the inside, which are joined together in a U-shape.

In an embodiment as shown in FIG. 4, the first antiglare module 12 and the second antiglare module 14 are joined together in a U-shape and pushed over the top edge of the visor 5. In this arrangement, the second antiglare module 14 protrudes beyond the first antiglare module 12 toward the horizontal line of sight 11.

Figure 5:
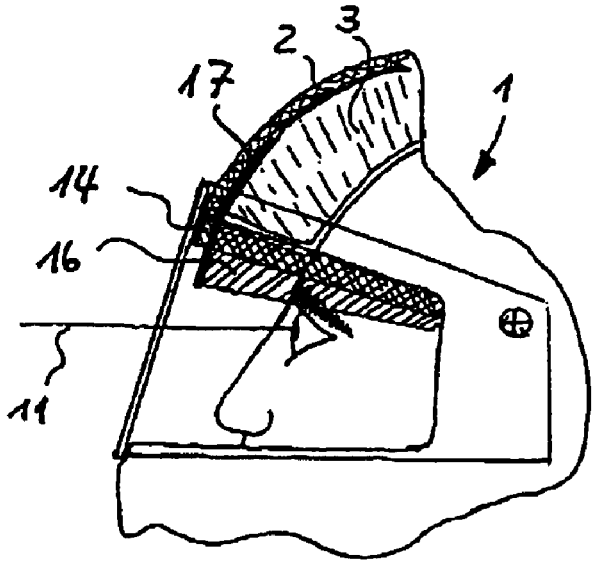
FIG. 5 is a partial side view of an antiglare system in cross-section and outline with an antiglare module arranged on the inside of the visor and an antiglare module arranged between the outer and inner helmet shells.

In an embodiment as shown in FIG. 5, the second antiglare module 14 is arranged on the inner side 15 of the visor 5 and the third antiglare module 16 is arranged between the outer and inner helmet shells 2, 3, and the third antiglare module 16 extends beyond the second antiglare module 14 toward the horizontal line of sight 11.

Figure 6:
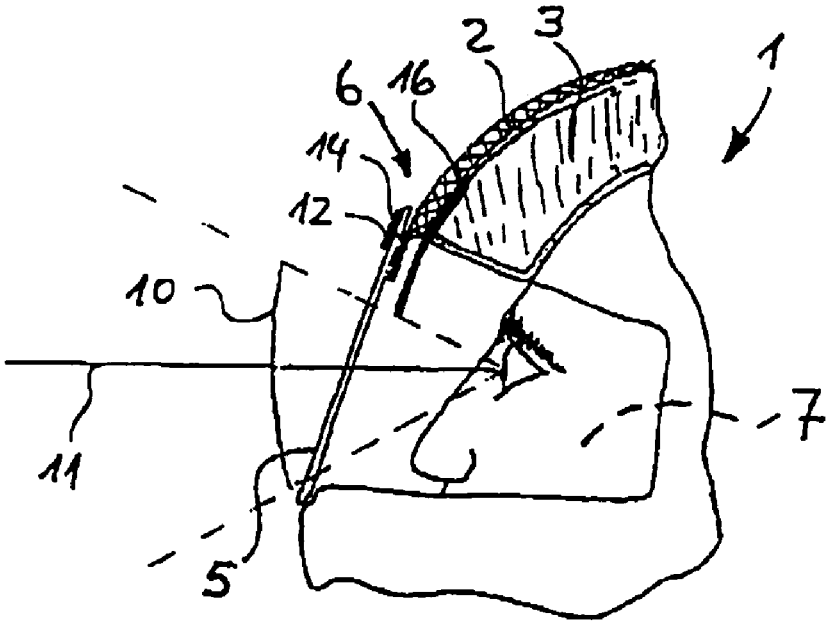
FIG. 6 is a side view of an antiglare system with three antiglare modules, where the helmet wearer's head is in a relaxed, upright position and with unimpeded visibility through the area of the visor not covered by the sunshade.
Figure 7:
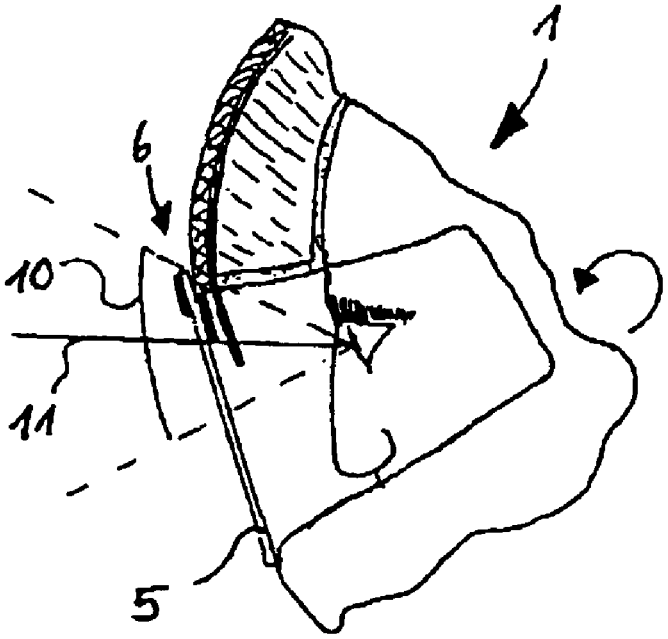
FIG. 7 is a side view of the antiglare system from FIG. 6 with the helmet wearer's head tilted forward in a position in which the sunshade extends into the vertical field of vision.

In an embodiment as shown in FIG. 6, the first antiglare module 12 and the second antiglare module 14 are arranged on the visor 5, while the third antiglare module 16 is arranged between the inner and outer helmet shells 2, 3. In this arrangement, the antiglare modules 12, 14, 16 extend beyond one another toward the horizontal line of sight 11.

The antiglare modules 12, 14, 16 are made of a transparent, tinted material. The antiglare modules 12, 14, 16 can have colors different from one another. The antiglare modules 12, 14, 16 additionally have a coating with reflective properties. In addition, the coating can have graphic elements.

The sunshade 6 is designed as a retrofit set including three antiglare modules 12, 14, 16, with which ordinary, commercial crash helmets can be individually retrofitted after market with the antiglare system in accordance with the invention.

When the helmet wearer's head is in a relaxed, upright position, the sunshade 6, or the antiglare modules 12, 14, 16, is located outside of the vertical field of vision 10. By tilting his head forward, the helmet wearer can let the sunshade 6 extend into his vertical field of vision 10. In the case of multiple antiglare modules 12, 14, 16, which extend over one another in graduated fashion, different antiglare effects can thus be achieved merely by tilting the head at different angles.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An antiglare system for a crash helmet having an outer and an inner helmet shell that has an eyeport, the antiglare system comprising a sunshade that partially covers the eyeport, wherein the sunshade has at least a first antiglare module that is located above a horizontal line of sight and outside of a vertical field of vision when the head of the helmet wearer is in a relaxed, fairly upright position, and wherein the helmet wearer can move the sunshade into the vertical field of vision by tipping the head of the helmet wearer forward, and wherein the antiglare module is arranged between the outer and inner helmet shells such that a substantial portion of an upper region of the antiglare module is positioned between the outer and inner helmet shells, wherein a horizontal extension of the upper region that is positioned between the outer and inner helmet shells is substantially greater than a vertical extension of the upper region that is positioned between the outer and inner helmet shells, the horizontal extension being substantially parallel to an upper edge formed by the eyeport.

2. The antiglare system in accordance with claim 1, wherein the sunshade has a second antiglare module parallel to the first antiglare module.

3. The antiglare system in accordance with claim 2, wherein the sunshade has a third antiglare module parallel to the second antiglare module.

4. The antiglare system in accordance with claim 3, wherein the first, second and third antiglare modules are a retrofit set that may be fitted to a crash helmet.

5. The antiglare system in accordance with claim 1, wherein the antiglare module is arranged on an outer side that faces away from the helmet wearer of a visor that can close the eyeport.

6. The antiglare system in accordance with claim 1, wherein the antiglare module is arranged on an inner side of the visor facing the helmet wearer.

7. The antiglare system in accordance with claim 2, wherein the antiglare modules extend beyond one another toward the horizontal line of sight.

8. The antiglare system in accordance with claim 2, wherein the antiglare modules are made of transparent, tinted material.

9. The antiglare system in accordance with claim 8, wherein the antiglare modules have different tints.

10. The antiglare system in accordance with claim 1, wherein the antiglare module has a coating.

11. The antiglare system in accordance with claim 10, wherein the coating has reflective properties.

12. The antiglare system in accordance with claim 10, wherein the coating has graphic elements.

13. The antiglare system in accordance with claim 1, wherein the antiglare module is secured against dislocation.

14. The antiglare system in accordance with claim 1, wherein the antiglare module is adhered to the visor.

15. The antiglare system in accordance with claim 1, wherein the antiglare module is secured against dislocation by fasteners.

16. The antiglare system in accordance with claim 15, wherein the fasteners are hook-and-loop fasteners.

17. The antiglare system in accordance with claim 1, wherein the antiglare module has, on its inner side facing away from a visor, at least one fastener that is made of a brushed velour material and has on its outer side facing away from the antiglare module a nap direction of the napped layer oriented away from an upper side of the antiglare module.

18. The antiglare system in accordance with claim 17, wherein the antiglare module has two fasteners that are arranged in the top region of the antiglare module located outside the visor opening.

19. The antiglare system in accordance with claim 2, wherein the first and second antiglare modules are joined together in a U-shape at their upper end facing away from the horizontal line of sight and contact the visor with their sides that face the visor.

20. The antiglare system according to claim 1, wherein the upper region of the antiglare module is completely positioned between the outer and inner shells.

21. An antiglare system comprising:

an antiglare module having an upper region and a lower region, the upper region being formed so as to be substantially positioned between an inner shell and an outer shell of a helmet such that the antiglare module substantially follows a contour of the helmet, the lower region extending from an upper edge of an eyeport, which is provided in the helmet, such that the lower region is above a horizontal line of sight when the helmet is in a first position and such that the lower region is within the horizontal line of sight when the helmet is in a second position, wherein a horizontal extension of the upper region that is positioned between the outer and inner helmet shells is substantially greater than a vertical extension of the upper region that is positioned between the outer and inner helmet shells, the horizontal extension being substantially parallel to an upper edge formed by the eyeport.

* * * * *